United States Patent [19]

Hara

[11] 4,189,697

[45] Feb. 19, 1980

[54] THERMAL CUT-OFF FUSE

[75] Inventor: Kunio Hara, Kawasaki, Japan

[73] Assignee: Nifco Inc., Kawasaki, Japan

[21] Appl. No.: 939,309

[22] Filed: Sep. 5, 1978

[30] Foreign Application Priority Data

Sep. 9, 1977 [JP] Japan ..... 52-120625[U]
Mar. 23, 1978 [JP] Japan ..... 53-32415

[51] Int. Cl.[2] ..... H01H 37/76
[52] U.S. Cl. ..... 337/407; 337/408
[58] Field of Search ..... 337/407, 408, 409, 413, 337/416

[56] References Cited

U.S. PATENT DOCUMENTS

| | | | |
|---|---|---|---|
| 2,934,628 | 4/1960 | Massar et al. | 337/409 |
| 3,930,215 | 12/1975 | Senor | 337/407 |
| 3,944,960 | 3/1976 | Audette et al. | 337/408 |
| 4,065,741 | 12/1977 | Sakamoto et al. | 337/409 |

*Primary Examiner*—George Harris

*Attorney, Agent, or Firm*—Glenn W. Bowen; Robert W. Beart

[57] ABSTRACT

In a thermal cut-off fuse of the class wherein electrical continuity of a contact means is maintained through the medium of a thermal pellet which is solid in its normal state and melts into a liquid state when the ambient temperature rises to reach a fixed level and the electrical continuity of the contact means, therefore, is broken by the thermal pellet being liquefied upon elevation of the ambient temperature to the fixed level, the improvement is attained by causing the thermal pellet which is in a solid state under the normal condition to restrain the movement of an actuating means kept pressed forward by an energizing means in such a way that, when the thermal pellet melts into its liquid state upon elevation of the ambient temperature to the fixed level, the thermal pellet releases the actuating means from the aforementioned restraint and enables it to thrust forward by virtue of the pressure constantly exerted by the energizing means to thereby break the electrical continuity of the contact means and retain the broken state of electrical continuity thereafter.

3 Claims, 3 Drawing Figures

THERMAL CUT-OFF FUSE

BACKGROUND OF THE INVENTION

This invention relates to a thermal cut-off fuse which, in an electric appliance provided with a heat source, cuts off the electric circuit in the electric appliance when the ambient temperature of the electric appliance, because of abnormal generation of heat therein for some cause or other, rises beyond the rated service temperature zone and reaches the dangerous temperature zone, whereby the abnormal generation of heat is terminated with high responsivity.

In an ordinary thermal cut-off fuse, there is used a thermal pellet made of a thermosensitive material which retains a solid state at temperatures below a fixed level and which, when the ambient temperaure rises to reach the fixed level, melts into a liquid state with a fair loss of the volume occupied when the material was in a solid state. Further, this thermal cut-off fuse is provided inside its housing with a contact means for establishing electrical continuity between the two lead wires so that the contact means is kept in its closed state insofar as the thermal pellet retains its solid state and, when the pellet melts into a liquid state and loses its volume, this loss of the volume of the thermal pellet gives rise to an allowance of space for the contact means to release itself, by virtue of its own elasticity, from a restraining force exerted thereon, consequently open the contact and break the electrical continuity through the contact means.

In any of the conventional mechanisms for thermal cut-off fuses, once the electrical continuity between the two lead wires is broken, a space is simply left to intervence between the contact means and the portion of the opposed part to which the contact means was held in contact while the electrical continuity was still present. In other words, the contact means in effect is poised in mid air and, therefore, has a fair possibility of being readily swayed. When shocks are conveyed by chance to the electric appliance, the contact means which is supported to remain in its open state may possibly come into contact with some conductive material or causes the phenomenon of chattering to establish an accidental electrical continuity between the two lead wires.

An object of this invention is to provide a thermal cut-off fuse of high temperature-response accuracy, which once the ambient temperature rises to reach the fixed level of temperature rated for the electric appliance using the fuse and the fuse consequently breaks the electric circuit of the electric appliance, the fuse is not caused by external shocks or other impulses to produce an accidental electrical connection or an undersirable phenomenon such as chattering but maintains the broken state of electric continuity safely and, thus, provides highly reliable operation.

SUMMARY OF THE INVENTION

To accomplish the object described above according to the present invention, there is provided a thermal cut-off fuse which comprises a housing; an opposed contact portion adapted to form a contact at the leading end of a lead wire penetrating into the housing; a contact means composed of a contact member adapted to come into contact with the opposed contact portion and an elastic spring serving to press the contact member forward; a thermal pellet capable of retaining a solid state under normal condition and melting into a liquid state upon reaching the fixed level of temperature; an actuating means adapted to be restrained from movement by the thermal pellet retaining its solid state under normal condition and released from the aforementioned restraint by the thermal pellet melting into a liquid state upon elevation of the ambient temperature to the fixed level so as to allow the actuating means to advance forward and intervence between the contact member of the contact means and the opposed contact portion; and an energizing means serving to impart motion to the actuating means.

Under normal condition, the thermal pellet in a solid state intervences between the contact means and the actuating means. Thus, the contact means is not affected at all by the actuating means but is allowed to extend the electrical continuity to the opposed contact portion. When the ambient temperature rises to reach the fixed level of temperature, the thermal pellet melts into its liquid state and produces an allowance of space enough for the actuating means to separate the contact means from the opposed contact portion, giving rise to a state of electric interruption. After this interruption, the actuating means serves the purpose of safely retaining this broken state of electrical continuity.

The other objects and characteristic features of the present invention will become apparent from a description given in detail herein below with reference to the accompanying drawing.

DESCRIPTION OF THE PREFERRED EMBODIMENTS

Figure 1:
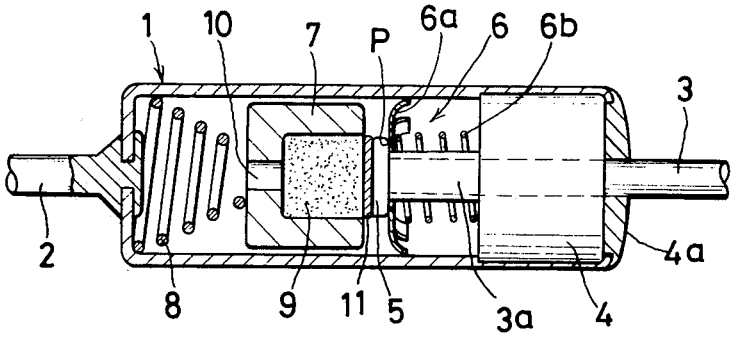
FIG. 1 is a sectioned explanatory diagram of the thermal cut-off fuse of the present invention in a state retaining electrical continuity between the lead wires under normal condition.
Figure 2:
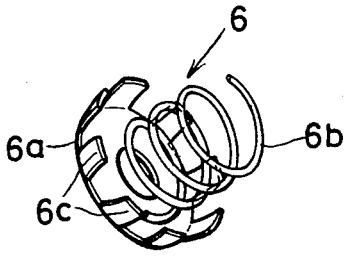
FIG. 2 is perspective view of the contact means to be used in the thermal cut-off fuse of FIG. 1.
Figure 3:
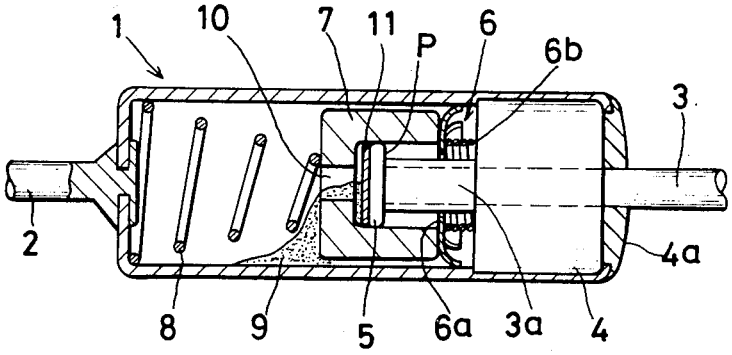
FIG. 3 is a sectioned explanatory diagram of the thermal cut-off fuse of FIG. 1 in a state retaining a broken state of electrical continuity at the fixed level of temperature.

In the thermal cut-off fuse of the present invention, a hollow housing 1 made of a conductive material and having one open end forms an overall outer shell. To the closed end of this housing, one of the lead wires 2 is connected fast.

The other lead wire 3 is inserted through the open end of the housing into the housing interior and fastened to the inner wall of the housing in such a manner as to be insulated from the housing with an insulating material such as, for example, a suitable synthetic resin or ceramic bushing 4. The fastening of the bushing 4 to the lead wire 3 and that of the bushing to the housing is effected such as by means of frictional force or by use of an adhesive agent 4*a*. The portion of the lead wire 3 which is exposed inside the housing is covered with an insulating coat 3*a* except the opposed contact portion 5 formed in the shape of an integral tube or may be integrally extended in the shape of a sleeve from one open edge of the bushing 4.

A contact means 6 which is retained in contact with the opposed contact portion 5 under normal condition comprises a member 6*a* adapted to adjoin the contact point P of the opposed contact portion 5 and an elastic spring 6*b* disposed helically around the covered portion 3a of the lead wire between the member 6a and the bushing 4 so as to keep the member 6a pressed against the contact point P under normal condition.

The member 6a adapted to adjoin the contact point P has its peripheral edge divided into a plurality of small protuberances 6c by insertion of as many spaced slits and folded back so as to conform to the inside sectional area of the housing. These small protuberances 6c are constantly held in contact with the inner wall of the housing so as to maintain electrical connection therebetween even when they slide relative to the inner wall. Since the member 6a contains at the center thereof an opening for permitting passage of the covered part of the lead wire 3a, the member 6a as a whole is permitted to slide in the axial direction along the inner wall of the housing. Under the normal condition, the member 6a is kept constantly pressed against the opposed contact portion 5 by the expulsive force of the elastic spring 6b so as to maintain electrical continuity between the two lead wires 2, 3.

Further, there is provided a breaking mechanism which, as soon as the ambient temperature reaches the fixed level, serves to separate immediately the member 6a from the opposed contact portion 5 to break the existing electrical continuity. One of the two elements of this breaking mechanism is an actuating means 7 serving to push the member 6a in the axial direction away from the opposed contact portion 5 and the other element is an energizing means 8 serving to impart a pushing force to the actuating means 7 in the axial direction. The actuating means 7, while sliding in the axial direction, should not jerk in the radial direction. For this reason, it must possess a shape perfectly conforming with the inner wall of the housing 1 which serves as the guide for the actuating means only in the axial direction and must be made of an insulating material. With the consideration for various factors such as ease of fabrication, sturdiness and cost, it is desirably made of suitable synthetic resin or ceramic substance.

Further, in order for the actuating means 7 to accommodate therein a thermal pellet 9 capable of melting faithfully at a fixed temperature, the actuating means 7 has the shape of a hollow case with one lateral end closed. To permit effective discharge of the liquefied thermal pellet, the actuating means is desired to have a suitable escape hole 10 opened in the closed lateral end.

To preclude the possibility of the thermal pellet being accidentally melted by the heat generated owing to the contact resistance between the member 6a and the contact point P, it is desirable to have an insulating material 11 interposed between the thermal pellet 9 and the opposed contact portion 5.

While the thermal cut-off fuse of the construction described above remains under the normal condition, i.e. the condition under which the ambient temperature is below the melting point of the thermal pellet, the thermal pellet 9 is in a solid state and, therefore, restrains the movement of the actuating means 7 in spite of the expulsive force of the energizing means 8 as illustrated in FIG. 1. Thus, the actuating means 7 is prevented from moving in the axial direction. As the result, the member 6a pushed forward by the elastic spring 6b is pressed against the opposed contact portion 5 to establish electrical continuity with the contact point P.

As the ambient temperature of the thermal fuse rises to reach the fixed level (the melting point of the thermal pellet), the thermal pellet 9 sensitively responds and immediately liquefies. As the liquefied thermal pellet 9 loses resistance, the actuating means 7 which is pushed forward by the energizing means 8 pushes the molten thermal pellet 9 through the escape hole 10 and the actuating means 7 is released from the restraint offered by the solid thermal pellet. Consequently, the opposed contact portion 5 is allowed to enter the void formed within the actuating means 7 in consequence of the discharge of the liquefied thermal pellet. As the result, the member 6a which has so far been kept pushed forward by the elastic spring 6b has less expulsive force than the energizing means 8 readily separates from the opposed contact portion 5 and retracts. Thus, the electrical continuity from the housing 1 to the lead wire 3 is broken. Since the actuating means is completely immobilized with the pressure exerted by the energizing means 8, the broken state of electrical continuity is retained safely because vibrations and other external impulses possibly exerted on the member 6a are not capable of bringing the member 6a into contact with the opposed contact portion. On the other hand, since the member 6a is constantly pressed by the elastic spring 6b having elasticity which is weaker than that of the energizing means 8 but which is nevertheless appropriate for the purpose of the elastic spring, it is also prevented from run out or accidental contact, making the retention of the broken state of electrical continuity all the more secure.

As described above, since the thermal pellet which has outstanding temeprature responsivity is used as the element directly responding to the fixed level of temperature, this invention provides a thermal cutoff fuse capable of breaking the electrical continuity without error at the fixed temperature.

As to one contact point which exists between the inner wall of the housing and the contact means 6, since this contact is made by the plurality of small protuberances 6c of the member 6a, the contact resistance is less than when the contact is made by a single peripheral edge of the member 6a. As to the other contact point which occurs between the opposed contact portion 5 and the member 6a, the contact resistance is similarly low because of the expulsive force exerted by the elastic spring 6b. The thermal cut-off fuse of this invention, therefore, causes little loss of power when it is inserted in an electric circuit, operates safely and proves useful as an active element.

What is claimed is:

1. A thermal cut-off fuse, which comprises in combination:

a conductive housing serving to maintain electrical continuity on one end thereof with one of the two lead wires;

an opposed contact portion forming an electrical contact at the leading end of the other lead wire entering the the housing at the other end in an insulated state;

a contact means formed of a contact member adapted to come into contact with the aforementioned opposed contact portion and an elastic spring serving to press the contact member against the opposed contact portion;

a thermal pellet accommodated inside the housing and capable of retaining a solid state under the normal condition and melting into a liquid state at a fixed level of temperature;

an actuating means adapted so that the movement thereof is restrained by the thermal pellet retaining its solid state under the normal condition to permit the electrical continuity between the opposed contact portion and the contact means and the restraint of the movement thereof is released by the thermal pellet melting into a liquid state at the fixed level of temperature to separate the contact member of the contact means from the opposed contact portion and thereby break the existing electrical continuity; and an energizing means adapted to impart movement to the actuating means;

whereby the electrical continuity is maintained under the normal condition and, upon elevation of the ambient temperature to the fixed level, the electrical continuity is broken and the broken state of electrical continuity is maintained thereafter by the actuating means being interposed between the opposed contact portion and the contact means.

2. The thermal cut-off fuse according to claim 1, wherein the contact member of the contact means has its peripheral edge divided into a plurality of small protuberances by insertion of as many spaced slits and the small protuberances are folded back into a shape conforming with the inner wall of the housing so as to ensure intimate contact thereof with the housing.

3. The thermal cut-off fuse according to claim 1, wherein the actuating means is formed in the shape of a cylinder having one closed end containing an escape hole for permitting discharge of the liquefied thermal pellet.

* * * * *